US007982575B2

(12) United States Patent
Wada et al.

(10) Patent No.: US 7,982,575 B2
(45) Date of Patent: Jul. 19, 2011

(54) INSULATING MEMBER

(75) Inventors: Junichi Wada, Chita-gun (JP); Junji Shirai, Kariya (JP)

(73) Assignee: Denso Corporation, Kariya (JP)

( * ) Notice: Subject to any disclaimer, the term of this patent is extended or adjusted under 35 U.S.C. 154(b) by 865 days.

(21) Appl. No.: 11/957,556

(22) Filed: Dec. 17, 2007

(65) Prior Publication Data

US 2008/0157908 A1 Jul. 3, 2008

(30) Foreign Application Priority Data

Dec. 27, 2006 (JP) ..... 2006-351958

(51) Int. Cl.
*H01F 27/30* (2006.01)

(52) U.S. Cl. ..... 336/205

(58) Field of Classification Search ..... 336/65, 336/90–96, 107, 192, 205–208; 123/634–635
See application file for complete search history.

(56) References Cited

FOREIGN PATENT DOCUMENTS

| | | | |
|---|---|---|---|
| JP | 5-39396 | | 12/1993 |
| JP | 05345881 | A * | 12/1993 |
| JP | 8-339928 | | 12/1996 |
| JP | 10275528 | A * | 10/1998 |
| JP | 11279411 | A * | 10/1999 |
| JP | 2003142325 | A * | 5/2003 |

* cited by examiner

*Primary Examiner* — Tuyen Nguyen
(74) *Attorney, Agent, or Firm* — Nixon & Vanderhye, PC

(57) ABSTRACT

An ignition coil, which includes a primary coil and a secondary coil, has an electrical insulating member. The electrical insulating member includes an insulating material being a base material. The electrical insulating member further includes a reactive agent being an additive added to the insulating material for causing dehydration-decomposition, so as to enhance durability when being applied with high voltage. Alternatively, a reactive agent is coated on a surface of the electrical insulating body for causing dehydration-decomposition, so as to enhance durability when being applied with high voltage.

13 Claims, 3 Drawing Sheets

INSULATING MEMBER

CROSS REFERENCE TO RELATED APPLICATIONS

This application is based on and incorporates herein by reference Japanese Patent Application No. 2006-351958 filed on Dec. 27, 2006.

FIELD OF THE INVENTION

The present invention relates to an insulating member.

BACKGROUND OF THE INVENTION

An ignition coil is provided to an internal combustion engine, such as a vehicular engine. The ignition coil includes a primary coil and secondary coil arranged coaxially with each other. The ignition coil generates high voltage of 20 to 40 kV in the secondary coil by utilizing electromagnetic induction. The secondary coil is connected with a sparkplug including a pair of electrodes. The electrodes spark by being applied with the high voltage, thereby causing combustion in the internal combustion engine. Ignition coils include various kinds of insulating resin such as polyphenylene sulfide (PPS), polybutylene terephthalate (PBT), polyethylene terephthalate (PET), polyphenylene ether (PPE), and epoxy resin being resistive against high voltage.

For example, JP-A-8-339928 discloses an ignition coil for internal combustion engine. In the ignition coil of JP-A-8-339928, a case of the ignition coil and a primary bobbin are formed of PPS resin instead of conventional PBT resin. In this structure, the ignition coil is downsized while maintaining output energy.

In recent years, development of vehicular engines has been proceeded to achieve high output, low fuel consumption, and low emission. In addition, an ignition system is demanded to produce higher voltage year by year. Therefore, it is demanded to improve an insulated member for an ignition coil to enhance corona lifetime corresponding to durability when being applied with high voltage for a long period.

SUMMARY OF THE INVENTION

In view of the foregoing and other problem, it is an object of the present invention to produce an insulating member enhanced in durability when being applied with high voltage.

According to one aspect of the present invention, an electrical insulating member for an ignition coil including a primary coil and a secondary coil, the electrical insulating member comprises an insulating material being a base material. The electrical insulating member further comprises a reactive agent being an additive added to the insulating material for causing dehydration-decomposition.

According to another aspect of the present invention, an electrical insulating member for an ignition coil including a primary coil and a secondary coil, the electrical insulating member comprises an electrical insulating body being a base component. The electrical insulating member further comprising: a reactive agent coated on a surface of the electrical insulating body for causing dehydration-decomposition.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

As follows, an electrical insulating member for an ignition coil 1 is described with reference to FIGS. 1 to 4.

Figure 1:
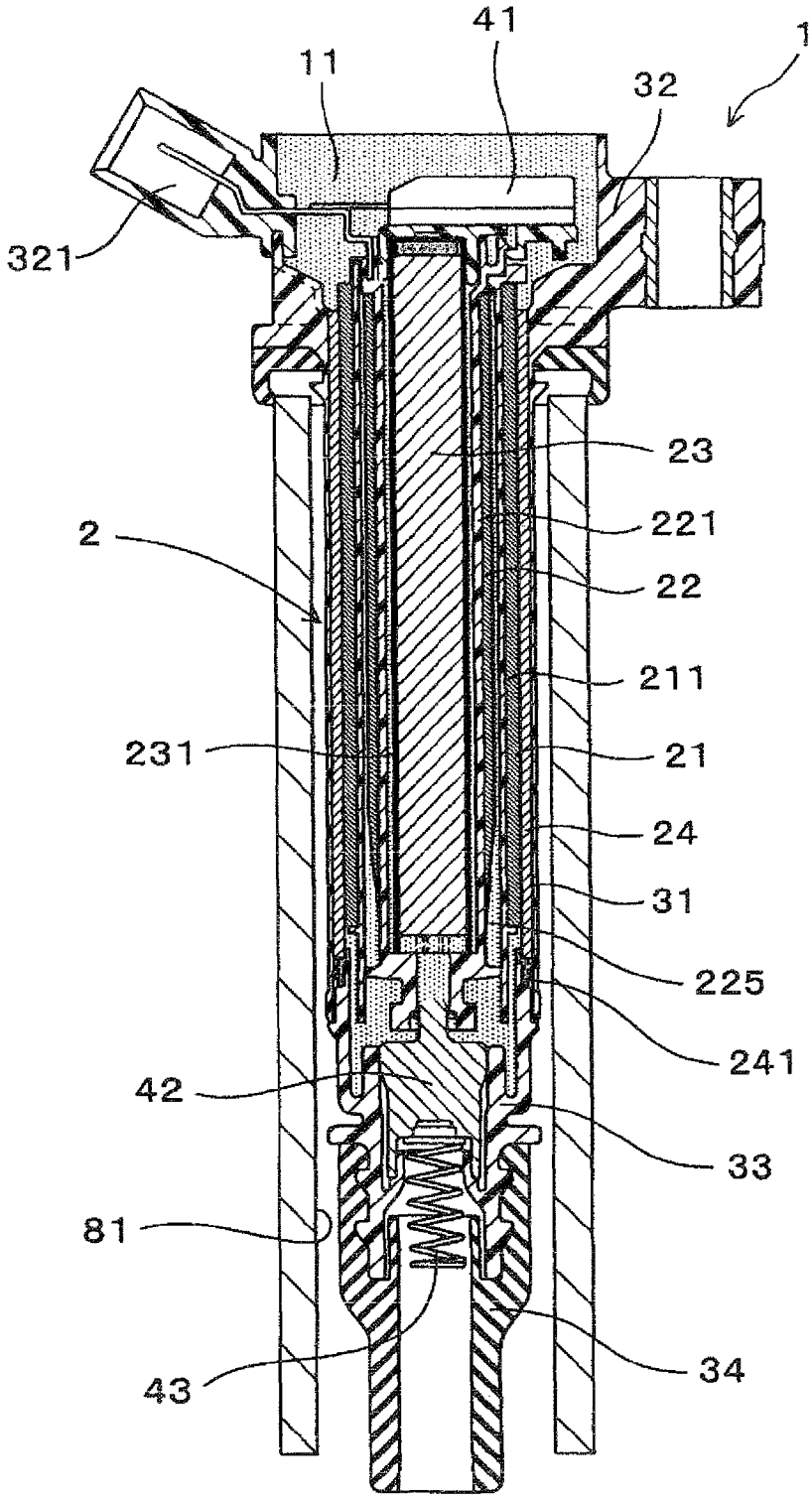
FIGS. 1, 2 are sectional views each showing an ignition coil.

In the present embodiment, as shown in FIG. 1, the ignition coil 1 has a stick-type structure including a coil portion 2 having a primary coil 21 and a secondary coil 22 inserted into a plug hole 81 of a cylinder head cover of an engine.

A center core 23 formed of a soft magnetic material is provided on the radially inner side of both the primary coil 21 and the secondary coil 22. An outer core 24 formed of a soft magnetic material is provided on the radially outer side of both the primary coil 21 and the secondary coil 22.

The primary coil 21 is formed by winding a wire around an outer periphery of a primary spool 211 formed of thermoplastic resin to be substantially in an annular shape in cross section.

The secondary coil 22 is formed by winding a wire around an outer periphery of a secondary spool 221 formed of thermoplastic resin to be substantially in an annular shape in cross section. The wire of the secondary coil 22 is less than the wire of the primary coil 21 in diameter. The wire of the secondary coil 22 is wound by a number of turns, which is greater than a number of turns of the wire of the primary coil 21.

The primary coil 21, the secondary coil 22, the center core 23, and the outer core 24 are accommodated in a coil case 31 formed of thermoplastic resin.

As shown in FIG. 1, the coil case 31 has a high-voltage end connected with a high-voltage tower member 33 formed of thermoplastic resin to be substantially in an annular shape in cross section. The high-voltage tower member 33 accommodates a high-voltage terminal 42 electrically connected with a high-voltage side end 225 of the secondary coil 22.

The high-voltage tower member 33 is formed of rubber to be substantially in an annular shape in cross section, and is equipped with a plug mount member 34 adapted to being attached with a sparkplug.

A spring 43 is provided inside the plug mount member 34, and is electrically connected with a terminal of the sparkplug attached to the inner periphery of the plug mount member 34.

The coil case 31 has a low-voltage end provided with a connector case 32, which is equipped with a connector portion 321 via which the ignition coil 1 is electrically connected with an electronic control unit (ECU) of the engine. The connector case 32 accommodates an igniter 41 having an electric power control circuit. The connector case 32, the coil case 31, and the high-voltage tower member 33 thereamong define a gap in the ignition coil 1, and the gap is filled with a filler 11 formed of thermosetting resin.

Referring to FIG. 1, the center core 23 is constructed by stacking electrical steel sheets such as silicon steel sheets perpendicularly to the axial direction thereof. A protective member 231 such as a tape and a tube is provided around the outer periphery of the center core 23 to protect the filler 11 from an edge of the electrical steel sheets constructing the center core 23. The protective member may be formed of an elastic member such as resin and rubber.

The high-voltage end of the outer core 24 is provided with an elastic member 241 for relaxing compression stress exerted in the axial direction of the outer core 24 along which the outer core 24 is magnetized. The elastic member 241 may be formed of rubber.

In the present embodiment, the electrical insulating member constructs at least one of the primary spool 211, the secondary spool 221, the high-voltage tower member 33, the plug mount member 34, the filler 11, the protective member 231, and the elastic member 241.

The primary spool 211 and the secondary spool 221 may be formed of polyphenylether resin (PPE resin) as a base material of an electrical insulating material, and by adding reactive agent for dehydration-decomposition to the PPE resin. The high-voltage tower member 33 may be formed of polyphenylene sulphide resin (PPS resin) as a base material of an electrical insulating material, and by adding reactive agent for dehydration-decomposition to the PPS resin.

The plug mount member 34 may be formed of silicone rubber as a base material of an electrical insulating material, and by adding reactive agent for dehydration-decomposition to the silicone rubber. The filler 11 may be formed of epoxy resin as a base material of an electrical insulating material, and by adding reactive agent for dehydration-decomposition to the epoxy resin.

Each of the electrical insulating members may be formed of the base material of the electrical insulating material by adding reactive agent for dehydration-decomposition such as magnesium hydroxide (MgOH2) and aluminum hydroxide (AlOH3) to the electrical insulating material.

The amount of the reactive agent for dehydration-decomposition is preferably 5 to 35 wt % of the total of electrical insulating member.

The electrical insulating member may be formed by adding a reinforcing material such as filler, and other additives to the electrical insulating material as the base material and the reactive agent for dehydration-decomposition.

In the present embodiment, when the primary coil 21 is supplied with an electric current according to a pulse-shaped spark generating signal transmitted from the ECU, the primary coil 21 generates a magnetic field passing through the center core 23 and the outer core 24 in the ignition coil 1.

Subsequently, when the electric current supplied through the primary coil 21 is cutoff, the primary coil 21 is applied with voltage by self-induction, whereby the secondary coil 22 is applied with high voltage induced electromotive force by mutual induction. Thus, a spark is generated between a pair of electrodes of the sparkplug attached to the ignition coil 1.

In the present embodiment, the electrical insulating material as the base material is added with 5 to 35 wt % of the reactive agent for dehydration-decomposition with respect to the total of electrical insulating member. The electrical insulating material with this composition is resistive in a condition being applied with high-voltage for an extended time period, for example, five times of a lifetime of a conventional electrical insulating member or more. Thus, lifetime of the electrical insulating material can be significantly enhanced.

In the present embodiment, it is conceivable that the reactive agent for dehydration-decomposition causes a reaction of dehydration and decomposition to absorb corona heat caused in the electrical insulating material as the base material by being applied with high voltage, whereby cooling the electrical insulating material.

The electrical insulating member of the above composition can be restricted from being heated at high temperature, thereby the electrical insulating member can be protected from deterioration. Thus, the electrical insulating member can be enhanced in corona lifetime when being applied with high voltage.

Figure 2:
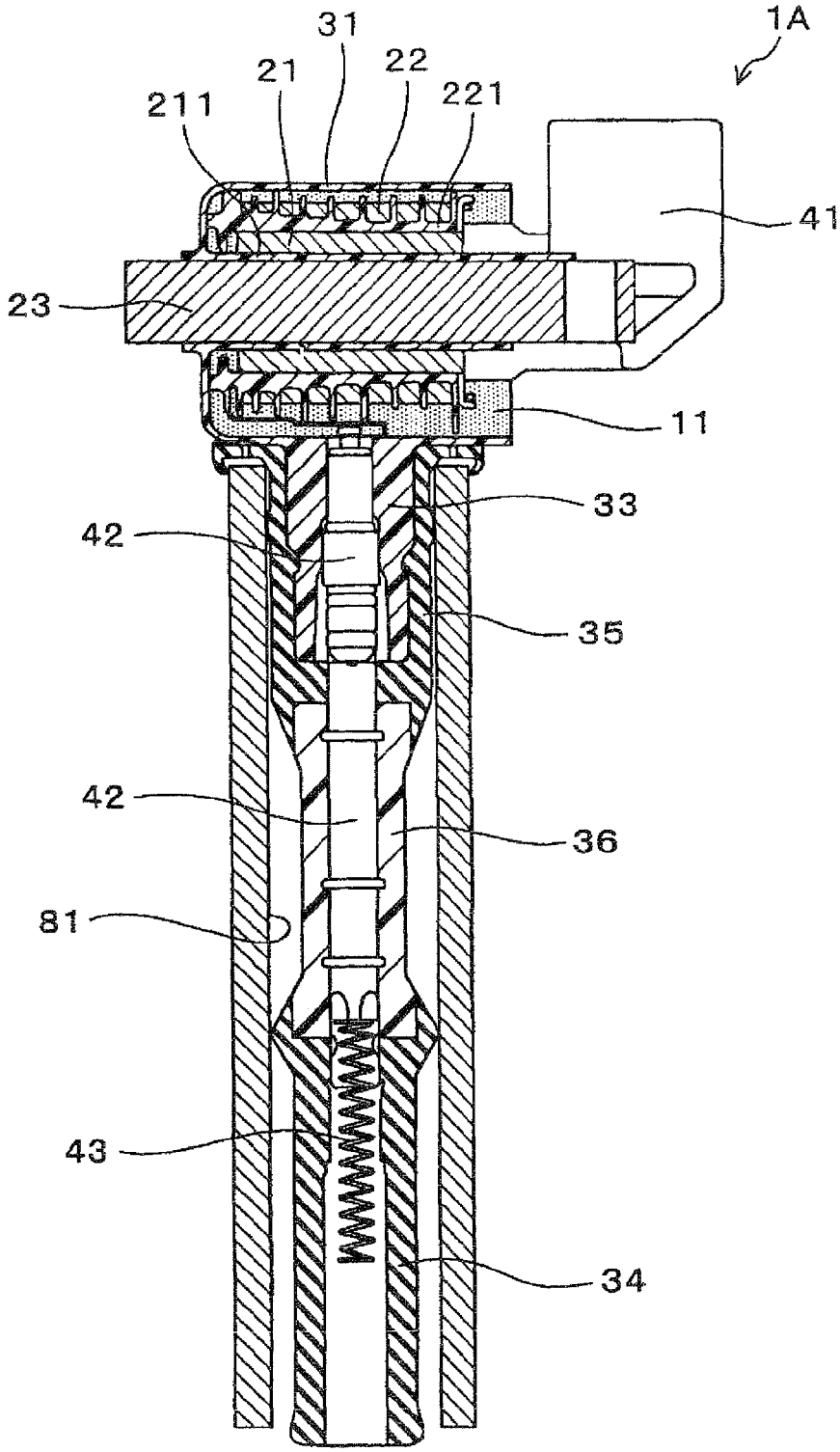

As shown in FIG. 2, the electrical insulating member may be applied to an ignition coil A having a rectangular-type structure including a primary coil 21 and a secondary coil 22 located outside the plughole of the cylinder head cover of the engine.

In this case, the high-voltage tower member 33 may be constructed of the coil case 31 that accommodates the center core 23, the primary coil 21, the secondary coil 22, and the like. The high-voltage tower member 33 may be joined with a second joint member 36, which is formed of resin, via a first joint member 35, which is formed of rubber, and may be attached with the plug mount member 34.

The filler 11 may be charged in the gap of the coil case 31.

In an ignition coil 1A having the rectangular-type structure, the electrical insulating member may include at least one of the primary spool 211, which is wound with the primary coil 21, the secondary spool 221, which is wound with the secondary coil 22, the high-voltage tower member 33, the first joint member 35, the second joint member 36, the plug mount member 34, and the filler 11.

The primary spool 211, the secondary spool 221, the high-voltage tower member 33, the plug mount member 34, and the filler 11 may be formed of an electrical insulating material, which is equivalent to the electrical insulating material of the ignition coil 1 having the stick-type structure, by adding reactive agent for dehydration-decomposition.

The first joint member 35 may be formed of silicone rubber as a base material of an electrical insulating material, and by adding reactive agent for dehydration-decomposition to the silicone rubber.

The second joint member 36 may be formed of PPS resin as a base material of an electrical insulating material, and by adding reactive agent for dehydration-decomposition to the PPS resin.

The primary spool 211 and the high-voltage tower member 33 may be formed of poly polybutylene terephthalate resin (PBT resin) as an insulating resin.

An electrical insulating material, which contains reactive agent to cause dehydration-decomposition, may be coated on a surface of an electrical insulating body as a base component.

In the present structure, in which the electrical insulating material is coated on the electrical insulating body, the electrical insulating body may be a product molded of various kinds of resin, rubber and the like being high in insulating property. In addition, the electrical insulating material may be adhesive of various kinds of resin, rubber and the like being high in adhesiveness relative to the electrical insulating body.

The electrical insulating member coated with the electrical insulating material may be applied to any one of the ignition coil 1 having the stick-type structure and the ignition coil 1A having the rectangular-type structure.

In the present embodiment, an experiment is carried out to evaluate an effect of the electrical insulating material formed of PPS resin added with reactive agent for dehydration-decomposition.

Specifically, in the present experiment, high voltage of 20 kV, 50 Hz is continuously applied to electrical insulating members added with respectively 0 wt %, 5 wt %, 10 wt % of reactive agent for dehydration-decomposition. The effects of the electrical insulating material is evaluated by measuring a time period (dielectric breakdown period) of dielectric breakdown between beginning of applying of the high voltage and a time point, at which the electrical insulating member cannot maintain its insulating property.

Here, a reference dielectric breakdown period is defined as 1 in a condition where the amount of reactive agent for dehydration-decomposition added to the electrical insulating material is 0 wt %. A lifetime ratio is defined as a ratio between the reference dielectric breakdown period and the dielectric breakdown period of the electrical insulating material added with one of 5 wt % and 10 wt % of reactive agent for dehydration-decomposition.

Figure 3:
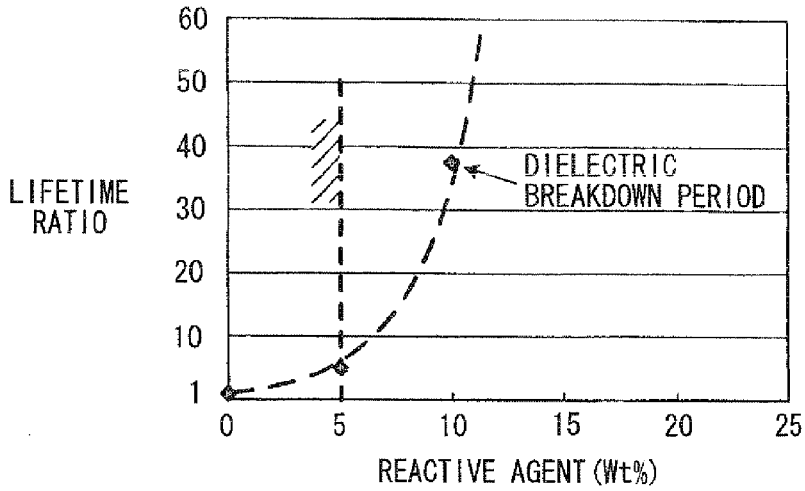
FIG. 3 is a graph showing a relationship between an amount of reactive agent for dehydration-decomposition and a lifetime ratio of an electrical insulating material of the ignition coil.

As shown in FIG. 3, the lifetime ratio significantly increases fivefold or greater by adding reactive agent for dehydration-decomposition of 5 wt % or greater. On the contrary when reactive agent for dehydration-decomposition is excessively added, the electrical insulating member may be degraded in mechanical property such as bending property and tensile strength, formability, and the like. Accordingly, it is conceived that the amount of reactive agent for dehydration-decomposition is preferably equal to or less than 35 wt %.

Figure 4:
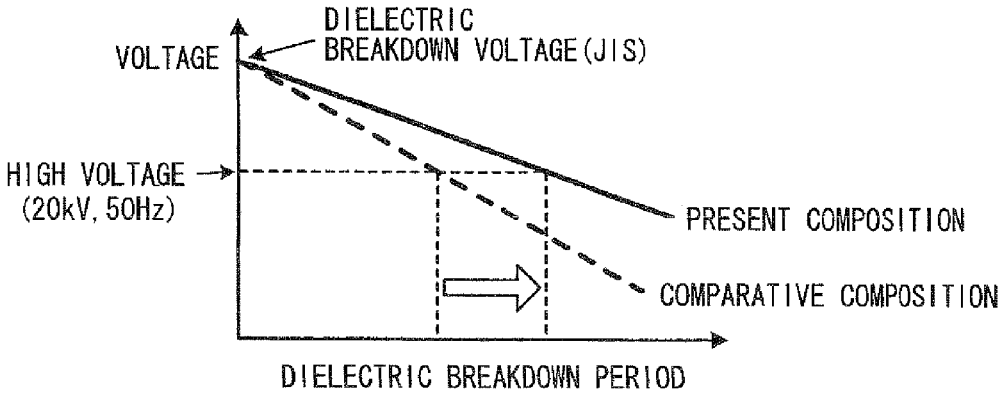
FIG. 4 is a graph showing a relationship between a dielectric breakdown period of an electrical insulating material of the ignition coil and voltage applied to the electrical insulating material.

As shown in FIG. 4, dielectric breakdown voltage of the present composition of the electrical insulating member added with the reactive agent for dehydration-decomposition is substantially equivalent to dielectric breakdown voltage of a comparative composition of an electrical insulating member, which is not added with the reactive agent for dehydration-decomposition.

The dielectric breakdown voltage is voltage, by which an electrical insulating member causes dielectric breakdown, and is defined by the Japanese Industrial Standards (JIS).

However, a period before causing a dielectric breakdown can be extended in the present composition of the electrical insulating member, whereby the corona lifetime of the electrical insulating member can be elongated under a condition where the electrical insulating member is applied with high voltage.

As described above, the reactive agent for dehydration-decomposition is preferably magnesium hydroxide (MgOH2) or aluminum hydroxide (AlOH3). Magnesium hydroxide and aluminum hydroxide can be easily obtained, so that the electric member can be easily produced.

As described above, the reactive agent for dehydration-decomposition is added preferably by 5 wt % or greater relative to the total of electrical insulating member. The reactive agent for dehydration-decomposition is added preferably by 5 wt % or greater to significantly elongate the corona lifetime of the electrical insulating member, for example, fivefold or greater. By contrast, when the reactive agent for dehydration-decomposition is added by less than 5 wt %, it is difficult to significantly elongate the corona lifetime of the electrical insulating member.

As described above, the reactive agent for dehydration-decomposition is added preferably by 35 wt % or less relative to the total of electrical insulating member. It is conceived that the reactive agent is consumed according to a period in which the electrical insulating member is applied with high voltage. Therefore, it is conceivable that the corona lifetime of the electrical insulating member applied with high voltage can be elongated as the amount of the reactive agent becomes large. On the contrary, when the reactive agent is excessively added, the electrical insulating member may be degraded in mechanical property such as bending property and tensile strength, formability, and the like. Accordingly, it is conceived that the amount of the reactive agent is preferably equal to or less than 35 wt %.

The electrical insulating member and the electrical insulating material are not limited to the application to an ignition coil. The electrical insulating member and the electrical insulating material may be applied to other components being applied with high voltage, such as an insulator fitting) an electric terminal and connector, a transformer, a power device, a capacitor, and the like.

The above structures of the embodiments can be combined as appropriate.

Various modifications and alternations may be diversely made to the above embodiments without departing from the spirit of the present invention.

What is claimed is:

1. An electrical insulating member for an ignition coil including a primary coil and a secondary coil, the electrical insulating member comprising:

an insulating material being a base material; and a reactive agent being an additive added to the insulating material for causing dehydration-decomposition, wherein the insulating member comprises:

a high-voltage tower member connected with at least one of a primary spool, a secondary spool, a coil case, the primary spool being wound with the primary coil, the secondary spool being wound with the secondary coil, the coil case accommodating the primary coil and the secondary coil, and the high-voltage tower member accommodating a high-voltage terminal electrically conducted with a high-voltage side end of the secondary coil; and a joint member connecting the high-voltage tower member with the plug mount member, the high-voltage tower member and the joint member are formed of polyphenylene sulphide resin as the base material, a content of the reactive agent is 5 percent or greater by weight of total of the insulating member, and the reactive agent is adapted to absorb corona heat caused in the electrical insulating material and to cool the electrical insulating material.

2. The electrical insulating member according to claim 1, the insulating member further including at least one of:

the primary spool;

the secondary spool;

the coil case a plug mount member connected to the high-voltage tower member, wherein the plug mount member is adapted to be mounted with a sparkplug such that the sparkplug is electrically insulated from the plug mount member; and a filler filling a gap in the ignition coil.

3. The electrical insulating member according to claim 1, wherein the reactive agent is one of magnesium hydroxide and aluminum hydroxide.

4. The electrical insulating member according to claim 1, wherein a content of the reactive agent is 35 percent or less by weight of total of the insulating member.

5. The electrical insulating member according to claim 1, wherein the primary spool and the secondary spool is formed of polyphenylether resin as the base material.

6. The electrical insulating member according to claim 1, wherein the insulating member further includes:

a plug mount member connected to the high-voltage tower member and formed of silicone rubber as the base material, wherein the plug mount member is adapted to be mounted with a sparkplug such that the sparkplug is electrically insulated from the plug mount member.

7. The electrical insulating member according to claim 1, wherein the insulating member further includes:

a filler filling a gap in the ignition coil and formed of epoxy resin as the base material.

8. An electrical insulating member for an ignition coil including a primary coil and a secondary coil, the electrical insulating member comprising:

an electrical insulating body being a base component; and a reactive agent coated on a surface of the electrical insulating body for causing dehydration-decomposition, wherein the insulating member comprises:

a high-voltage tower member connected with at least one of a primary spool, a secondary spool, a coil case, the primary spool being wound with the primary coil, the secondary spool being wound with the secondary coil, the coil case accommodating the primary coil and the secondary coil, and the high-voltage tower member accommodating a high-voltage terminal electrically conducted with a high-voltage side end of the secondary coil; and a joint member connecting the high-voltage tower member with the plug mount member, the high-voltage tower member and the joint member are formed of polyphenylene sulphide resin as the base material, a content of the reactive agent is 5 percent or greater by weight of total of the insulating member, and the reactive agent is adapted to absorb corona heat caused in the electrical insulating material and to cool the electrical insulating material.

9. The electrical insulating member according to claim 8, the insulating member further including at least one of:

the primary spool the secondary spool the coil case a plug mount member connected to the high-voltage tower member, wherein the plug mount member is adapted to be mounted with a sparkplug such that the sparkplug is electrically insulated from the plug mount member; and a filler filling a gap in the ignition coil.

10. The electrical insulating member according to claim 8, wherein the reactive agent is one of magnesium hydroxide and aluminum hydroxide.

11. The electrical insulating member according to claim 8, wherein the primary spool and the secondary spool is formed of polyphenylether resin as the base component.

12. The electrical insulating member according to claim 8, wherein the insulating member further includes:

a plug mount member connected to the high-voltage tower member formed of silicone rubber as the base component, wherein the plug mount member is adapted to be mounted with a sparkplug such that the sparkplug is electrically insulated from the plug mount member.

13. The electrical insulating member according to claim 8, wherein the insulating member further includes:

a filler filling a gap in the ignition coil and formed of epoxy resin as the base component.

* * * * *